US011060757B2

(12) United States Patent
Yang et al.

(10) Patent No.: US 11,060,757 B2
(45) Date of Patent: Jul. 13, 2021

(54) SYSTEM AND METHOD FOR REMOVING CONDENSATE FROM A COOLING UNIT

(71) Applicant: SCHNEIDER ELECTRIC IT CORPORATION, West Kingston, RI (US)

(72) Inventors: Hongwei Yang, Shanghai (CN); John H. Bean, Jr., Defiance, MO (US); Jinhui Wang, Shanghai (CN); Marlowe Dulaca Apuhin, Antipolo (PH); Bo Hong, Shanghai (CN)

(73) Assignee: SCHNEIDER ELECTRIC IT CORPORATION, Foxboro, MA (US)

( * ) Notice: Subject to any disclaimer, the term of this patent is extended or adjusted under 35 U.S.C. 154(b) by 242 days.

(21) Appl. No.: 16/331,246

(22) PCT Filed: Sep. 8, 2016

(86) PCT No.: PCT/CN2016/098429
§ 371 (c)(1),
(2) Date: Mar. 7, 2019

(87) PCT Pub. No.: WO2018/045530
PCT Pub. Date: Mar. 15, 2018

(65) Prior Publication Data

US 2020/0355395 A1 Nov. 12, 2020

(51) Int. Cl.
*F24F 6/12* (2006.01)
*F24F 13/22* (2006.01)

(52) U.S. Cl.
CPC ..... *F24F 13/222* (2013.01)

(58) Field of Classification Search
CPC ..... F24F 13/222; F24F 6/12
(Continued)

(56) References Cited

U.S. PATENT DOCUMENTS 2,234,753 A 3/1941 Frazer
2,576,976 A * 12/1951 Stagner ..... F24F 6/12 392/396

(Continued)

FOREIGN PATENT DOCUMENTS

CN 1590861 3/2005
CN 200996694 12/2007

(Continued)

OTHER PUBLICATIONS

International Search Report and Written Opinion from corresponding PCT/CN2016/098429 dated Jun. 5, 2017.

(Continued)

*Primary Examiner* — Filip Zec
(74) *Attorney, Agent, or Firm* — Lando & Anastasi, LLP

(57) ABSTRACT

A system for removing condensate from a cooling unit (10) includes a drain pan (44) to collect condensate generated by the cooling unit (10), a condensate pump (52) configured to pump condensate from the drain pan (44), and a water tank (54) in fluid communication with the condensate pump (52). The water tank (54) is configured to store condensate in the form of water delivered to the water tank (54) by the condensate pump (52). The system further includes a plunger pump (60) in fluid communication with the water tank (54). The plunger pump (60) is configured to pump water from the water tank (54). The system further includes at least one atomizing nozzle (62) in fluid communication with the plunger pump (60). The at least one atomizing nozzle (62) is configured to atomize water from the plunger pump (60).

18 Claims, 9 Drawing Sheets

(58) Field of Classification Search
USPC ..... 62/285–291
See application file for complete search history.

(56) References Cited

U.S. PATENT DOCUMENTS

| | | | | |
|---|---|---|---|---|
| 3,855,371 | A * | 12/1974 | Morrow | F24F 6/12 261/100 |
| 4,375,752 | A | 3/1983 | Stocking et al. | |
| 6,427,458 | B1 * | 8/2002 | Fowler | F24F 13/222 137/565.23 |
| 6,442,955 | B1 * | 9/2002 | Oakner | F24F 13/222 62/150 |
| 6,745,590 | B1 * | 6/2004 | Johnson | F25D 21/14 62/272 |
| 6,976,367 | B2 * | 12/2005 | Spanger | F24F 13/222 62/129 |
| 9,115,916 | B2 | 8/2015 | Tutunoglu et al. | |
| 2002/0046569 | A1 * | 4/2002 | Faqih | C02F 9/005 62/188 |
| 2002/0124582 | A1 | 9/2002 | Oakner et al. | |
| 2005/0138939 | A1 | 6/2005 | Spanger | |
| 2008/0000252 | A1 * | 1/2008 | Lee | F24F 1/04 62/291 |
| 2010/0037644 | A1 * | 2/2010 | Ward | F04B 17/04 62/291 |

FOREIGN PATENT DOCUMENTS

| | | | |
|---|---|---|---|
| CN | 201340055 | Y | 11/2009 |
| CN | 201926084 | U | 8/2011 |
| CN | 102927672 | A | 2/2013 |
| CN | 103175356 | A | 6/2013 |
| CN | 203731638 | U | 7/2014 |
| CN | 204648619 | | 9/2015 |
| JP | H07248128 | A | 9/1995 |
| KR | 20140067310 | A | 6/2014 |

OTHER PUBLICATIONS

Extended European Search Report from corresponding European Application No. 16915465.5 dated Mar. 18, 2020.

* cited by examiner

SYSTEM AND METHOD FOR REMOVING CONDENSATE FROM A COOLING UNIT

CROSS-REFERENCE TO RELATED APPLICATIONS

This application is a U.S. National Stage Application under 35 U.S.C. § 371 of International Application No. PCT/CN2016/098429, filed Sep. 8, 2016, titled SYSTEM AND METHOD FOR REMOVING CONDENSATE FROM A COOLING UNIT, which is hereby incorporated herein by reference in its entirety.

BACKGROUND OF DISCLOSURE

1. Field of Disclosure

The present disclosure relates generally to cooling systems, and more particularly to a system and a method configured to remove condensate from an enclosed cooling unit.

2. Discussion of Related Art

A cooling system having one or more cooling units can be used to remove heat generated in a room or building to maintain a suitable temperature and relative humidity in the room. As a result, individuals working in a room or a building feel comfortable, with the cooling units contained in the room or the building running safely without being noticed. When a cooling coil's evaporator temperature or inlet chilled water temperature is lower than a dew point of return air, condensate forms on fins of the cooling coil, and is collected in a drain pan positioned below the cooling coil.

There are two well-known methods to remove condensate from the cooling unit—a gravity drainage system and a drain pump system. Both of these methods require conveyance of the condensate to a suitable location for discharge. With gravity drainage systems, condensate collected in the drain pan flows in the drain line by the effect of gravity. A gravity drainage system is illustrated in FIG. 1. With drain pump systems, when the condensate in the drain pan reaches in certain level, a flow sensor is lifted or raised to activate a drain pump, which is configured to pump the condensate (water) disposed in the drain pan to a suitable location for discharge. When the condensate is below a certain level in the drain pan, the flow sensor will deactivate the drain pump. A drain pump system is illustrated in FIG. 2.

It is oftentimes difficult to implement these types of condensate removal systems, especially in data centers. In some embodiments, a data center is a self-contained, secure computing environment that includes all the storage, processing and networking required to run applications for a particular customer. The data center is transportable and can be configured to meet special customer requirements. The data center can be shipped in single enclosure, and may be configured to include all necessary power, cooling, security, and associated management tools.

SUMMARY OF DISCLOSURE

One aspect of the present disclosure is directed to a system for removing condensate from a cooling unit. In one embodiment, the system comprises a drain pan to collect condensate generated by the cooling unit, a condensate pump configured to pump condensate from the drain pan, and a water tank in fluid communication with the condensate pump. The water tank is configured to store condensate in the form of water delivered to the water tank by the condensate pump. The system further comprises a plunger pump in fluid communication with the water tank. The plunger pump is configured to pump water from the water tank. The system further comprises at least one atomizing nozzle in fluid communication with the plunger pump. The at least one atomizing nozzle is configured to atomize water from the plunger pump.

Embodiments of the system further may include positioning the at least one atomizing nozzle within an exhaust air duct of the cooling unit to exhaust relatively warm air from the cooling unit. The plunger pump may be configured to pressurize the water to 40 to 60 bar. The at least one atomizing nozzle may have a diameter of 0.08 mm to 0.3 mm. The system further may include a strainer in fluid communication with the condensate pump and the water tank to remove particulate matter from the condensate prior to entering the water tank. The water tank may include a low switch to shut off the plunger pump when water is lower than the low switch and a high switch to start the plunger pump when water is higher than the high switch. The water tank further may include includes an overflow switch to shut down the cooling unit when water is higher than the overflow switch. The low switch, the high switch and the overflow switch may be coupled to a controller that controls the operation of the system and the cooling unit. The drain pan may be positioned below an evaporator of the cooling unit. The system further may include at least one sensor provided in the water tank and a controller configured to control an operation of the condensate pump and the plunger pump based on readings taken by the at least one sensor.

Another aspect of the disclosure is directed to a method of removing condensate from a cooling unit. In one embodiment, the method comprises: collecting condensate in a drain pan of the cooling unit; pumping condensate from the drain pan to a water tank in fluid communication with a condensate pump, the water tank being configured to store condensate in the form of water delivered to the water tank by the condensate pump; and pumping water from the water tank to at least one atomizing nozzle in fluid communication with a plunger pump, the at least one atomizing nozzle being configured to atomize water from the plunger pump.

Embodiments of the method further may include positioning the at least one atomizing nozzle within an exhaust air duct of the cooling unit to exhaust relatively warm air from the cooling unit. The plunger pump may be configured to pressurize the water to 40 to 60 bar. The at least one atomizing nozzle may have a diameter of 0.08 mm to 0.3 mm. The method further may include straining the condensate prior to pumping the condensate to the water tank with a strainer in fluid communication with the condensate pump and the water tank to remove particulate matter from the condensate prior to entering the water tank. The method further may include shutting off the plunger pump with a low switch when water is lower than the low switch and starting the plunger pump with a high switch when water is higher than the high switch. The method further may include shutting down the cooling unit with an overflow switch when water is higher than the overflow switch. The low switch, the high switch and the overflow switch may be coupled to a controller that controls the operation of the system and the cooling unit. The method further may include positioning the drain pan below an evaporator of the cooling unit. The method further may include sensing an amount of water in the water tank with at least one sensor provided in the water tank and a controlling an operation of the condensate pump and the plunger pump based on readings taken by the at least one sensor.

BRIEF DESCRIPTION OF DRAWINGS

The accompanying drawings are not intended to be drawn to scale. In the drawings, each identical or nearly identical component that is illustrated in various figures is represented by a like numeral. For purposes of clarity, not every component may be labeled in every drawing. In the drawings.

DETAILED DESCRIPTION

Figure 1:
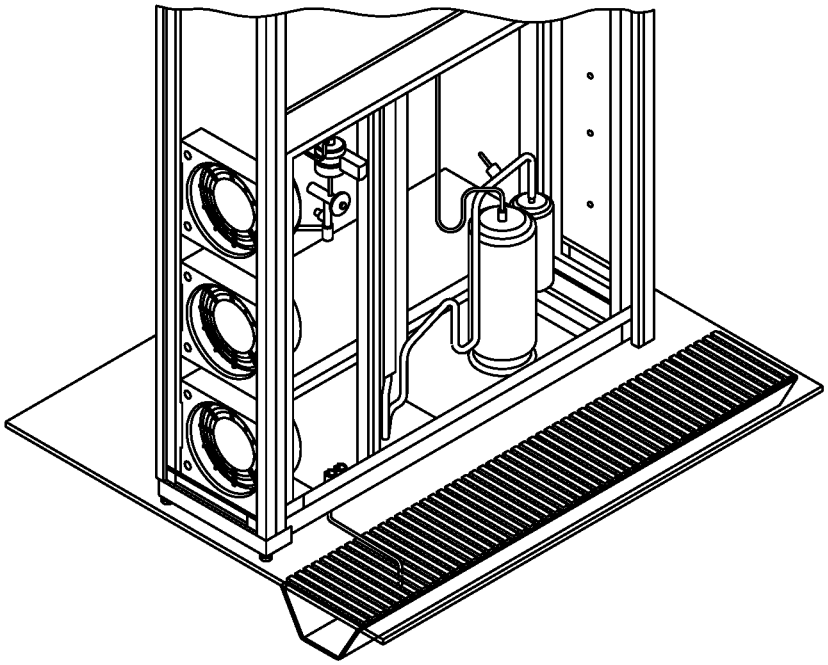
FIG. 1 (PRIOR ART)
FIG. 1 is a perspective view of a portion of a cooling unit having a gravity drainage system for removing condensate from the cooling unit.
Figure 2:
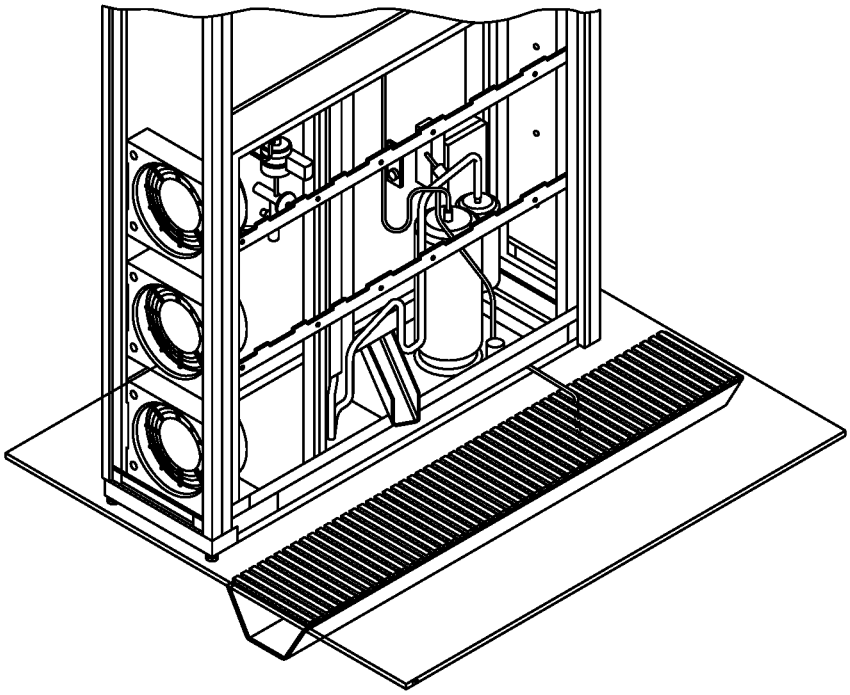
FIG. 2 (PRIOR ART)
FIG. 2 is a perspective view of a portion of a cooling unit having a drain pump system for removing condensate from the cooling unit.

This disclosure is not limited in its application to the details of construction and the arrangement of components set forth in the following description or illustrated in the drawings. The principles set forth in this disclosure are capable of being provided in other embodiments and of being practiced or of being carried out in various ways. Also, the phraseology and terminology used herein is for the purpose of description and should not be regarded as limiting. The use of "including," "comprising," "having," "containing," "involving," and variations thereof herein, is meant to encompass the items listed thereafter and equivalents thereof as well as additional items.

Figure 3A:
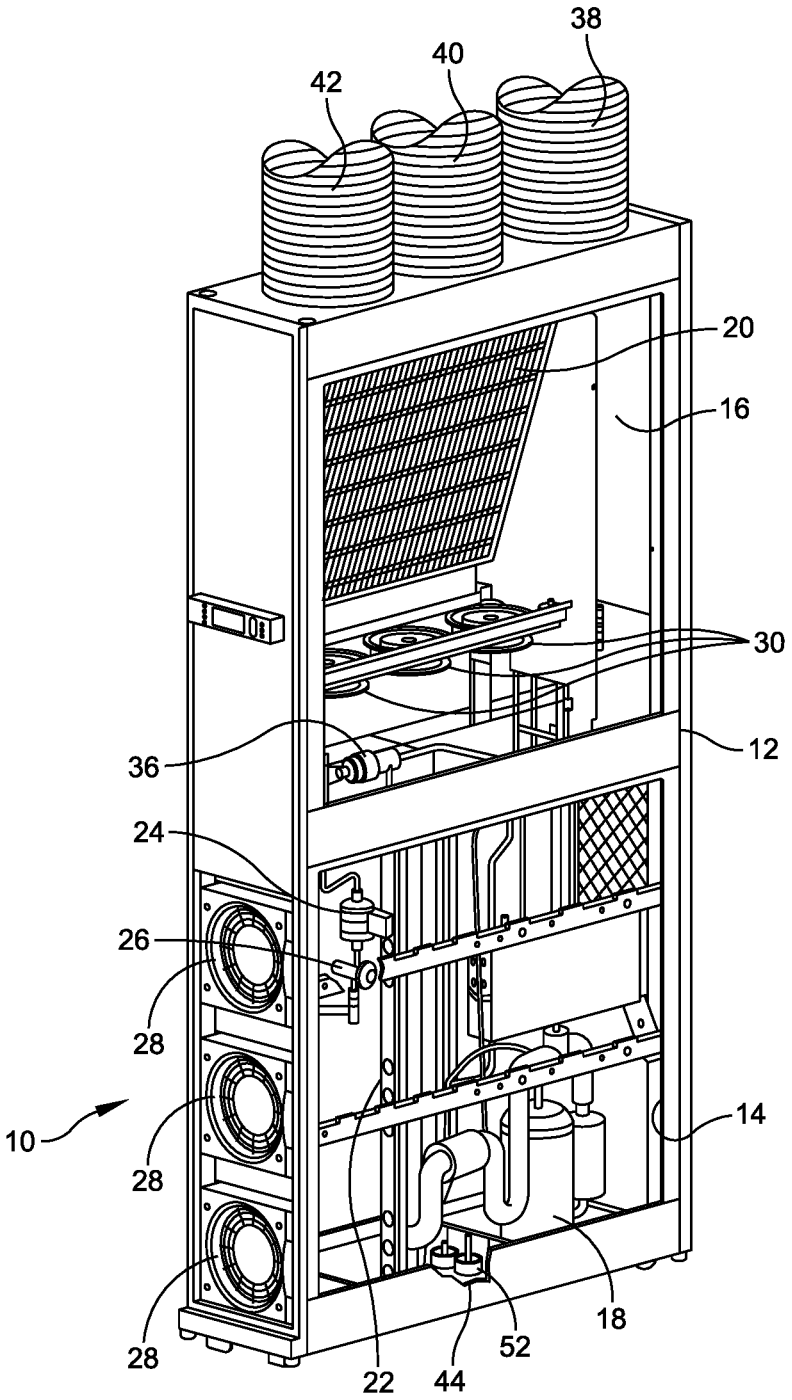
FIGS. 3A and 3B are perspective views of a cooling unit.
Figure 3B:
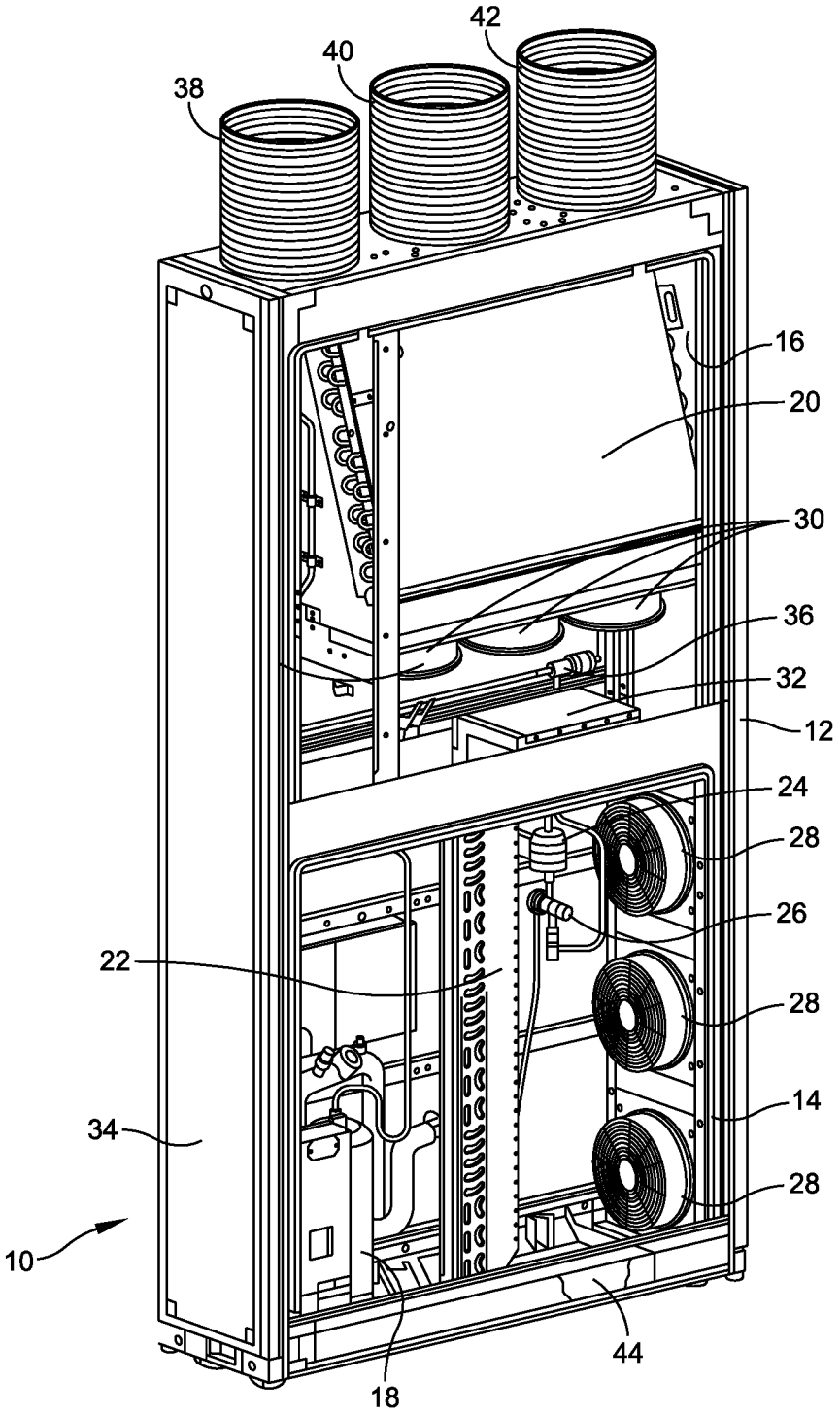

Referring to FIGS. 3A and 3B, in one embodiment, the cooling unit is a unitary air conditioner, which is generally indicated at 10. As shown, the cooling unit 10 includes a generally rectangular frame structure 12 having a bottom section 14 and a top section 16, each configured to support components of the cooling unit. The cooling unit 10 is configured to treat the air within a space containing, for example, electronic equipment, including closets, equipment rooms and data centers. Such spaces are adapted to house enclosures or equipment racks designed to house networking, telecommunication and other electronic equipment.

In one embodiment, the cooling unit 10 includes a compressor 18 positioned within the bottom section 14 of the frame structure 12 to deliver coolant under pressure to the components of the cooling unit. The pressurized coolant travels through a discharge pipe, which connects the compressor 18 to a condenser positioned in the top section 16 of the frame structure 12 of the cooling unit 10. A temperature sensor and a pressure transducer may be provided adjacent to the condenser 20 to measure the temperature and the pressure of the coolant as it enters the condenser. The condenser 20 includes a coil having thermally conductive fins configured to cool the heated coolant within the coil of the condenser. The air flow over the condenser 20 will be discussed in greater detail below.

Once the coolant is cooled within the condenser 20 (e.g., transitioning the coolant from an evaporated state to a condensed state), the coolant travels through another liquid pipe to an evaporator 22 provided in the bottom section 14 of the frame structure 12 of the cooling unit 10. Prior to entering the evaporator 22, the coolant first may travel through a filter drier 24 to eliminate impurities and to remove unwanted non-condensables within the coolant. Once through the filter drier 24, the coolant travels through a thermal expansion valve 26 to condition the coolant prior to entering the evaporator 22. Once heated by warm air passing over the evaporator 22, the evaporated coolant travels back to the compressor 18 via a section of suction piping. However, prior to entering the compressor 18, the coolant may pass through a compressor suction accumulator, which ensures that coolant enters into the compressor in an evaporated state. Another temperature sensor and another pressure transducer may be provided adjacent to the compressor 18.

The cooling unit 10 further includes several evaporator fans, e.g., three evaporator fans, each indicated at 28, to draw air from the environment outside the cooling unit over the evaporator 22. The cooling unit 10 further includes several condenser fans, e.g., three condenser fans, each indicated at 30, to draw air from a source of cool air over the condenser 20. The arrangement is such that high temperature coolant flows from the compressor 18 to the condenser 20. Pressure and temperature readings of the coolant are taken prior to the coolant entering the condenser 20, which cools the coolant by virtue of the relatively cool air passing over the coil and fins of the condenser. Once cooled, the coolant travels to the evaporator 22. The cooling unit 10 further includes a power supply 32 to power the components of the cooling unit. An air filter 34 is provided to filter air that is drawn over the evaporator 22 by the evaporator fans 28.

In some embodiments, the cooling unit 10 can further include a user interface box and a high voltage box. The user interface box is provided to enable a user or operator to interact with the cooling unit 10 locally. The high voltage box can serve as an electrical input junction that connects to one or more electrical input sources for the cooling unit. The cooling unit 10 can be configured for single input or dual input power.

In a certain embodiment, the cooling unit 10 further includes a bypass valve 36 to divert coolant normally directed to the condenser 20 from the compressor 18 to the evaporator 22 via another discharge pipe. In one embodiment, the bypass valve 36 is opened by a stepper motor provided with the bypass valve to divert a portion of coolant traveling to the condenser 20 to the evaporator 22 through a bypass discharge pipe. The operation of the bypass valve 36, which may sometimes be referred to as a hot gas bypass valve, can be manipulated to regulate the capacity of the cooling unit 10.

The cooling unit 10 further includes three air ducts 38, 40, 42 provided at a top of the top section 16 of the cooling unit. One air duct, the intake air duct 38, is used to suction ambient air (relatively cooler air) into the cooling unit 10 and over the condenser 20, and the two remaining air ducts, the exhaust air ducts 40, 42, are used to exhaust air from the condenser into ambient or a drop ceiling associated with the facility in which the cooling unit operates. The condenser fans 30 are configured to draw air from the intake air duct 38 and to exhaust air through the two exhaust air ducts 40, 42. Condensate generated on the evaporator 22 is collected in a drain pan 44 provided below the evaporator in the bottom section 14 of the frame structure 12 of the cooling unit 10. In prior art cooling units, the water collected in the drain pan 44 is drained out of cooling unit by a condensate pump after a flow switch in the drain pan is activated. At some equipment sites, a traditional condensate treatment bring inconveniences associated with removing the condensate as well as additional costs. For example, as mentioned above, a drain is oftentimes constructed inside the data center. Drain piping has to be carefully connected by following an installation manual to make sure correct drainage is provided. When the drain piping is connected, the portability of unit or system is limited.

Figure 4:
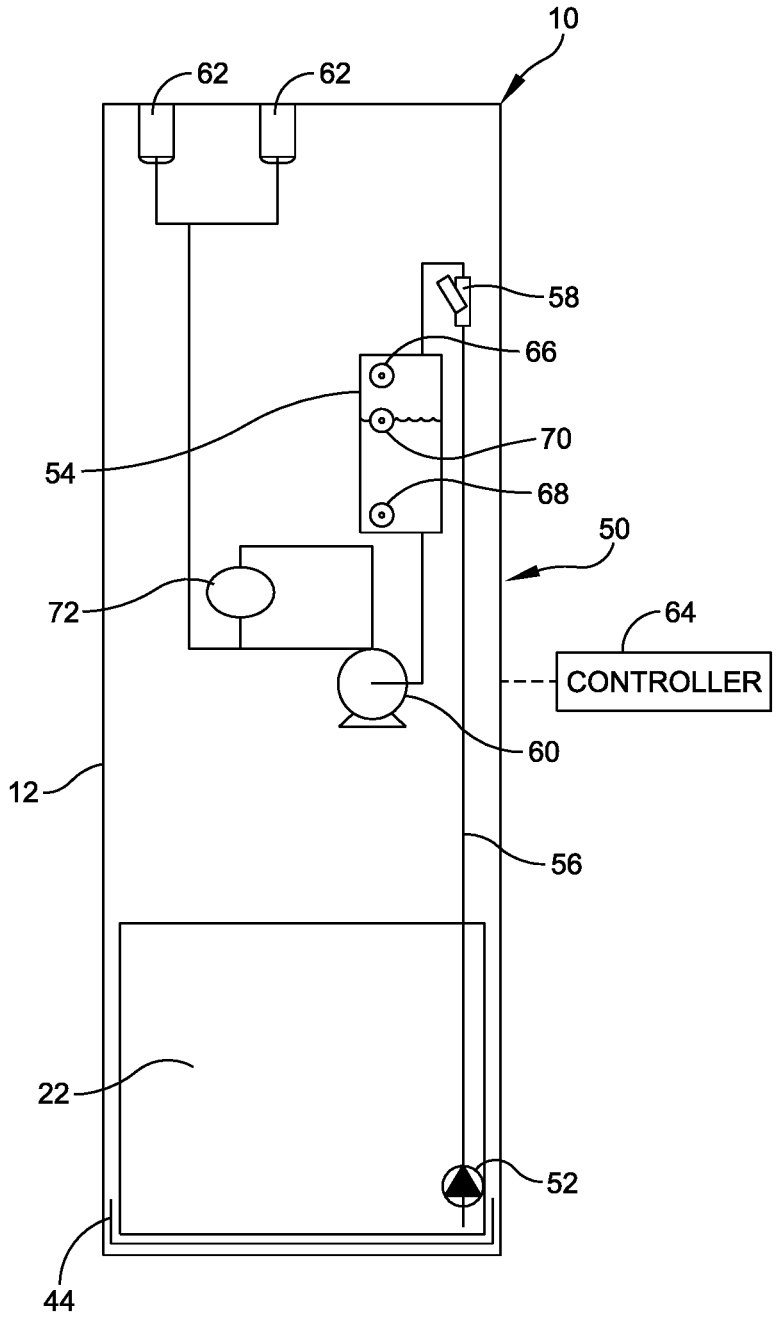
FIG. 4 is a schematic view of a system for removing condensate from the cooling system of an embodiment of the present disclosure.

Referring to FIG. 4, in one embodiment, the cooling unit 10 further includes a system for removing condensate from the cooling unit, generally indicated at 50, without having to provide a drain pipe or trenches. Specifically, the system 50 is designed to atomize the collected condensate in the exhaust air generated by the condenser 20 provided at the top section 16 of the frame structure 12 of the cooling unit 10. As shown, the system 50 includes the drain pan 44 provided at the bottom section 14 of the frame structure 12 to collect condensate from the evaporator 22. The system 50 further includes a condensate pump 52 disposed within the drain pan 44 to pump the condensate (water) to the top section 16 of the frame structure 12 of the cooling unit 10. As mentioned above, in one embodiment, the water collected in the drain pan 44 is drained out of the drain pan by the condensate pump 52 after a flow switch in the drain pan is activated.

The system 50 further includes a water tank 54 provided in the top section 16 of the frame structure 12 of the cooling unit 10. The water tank 54 is connected to the condensate pump 52 by a conduit 56, with a strainer 58 disposed in the conduit to remove particulates from the water pumped to the water tank. In one embodiment, the strainer 58 is a filter that is configured to remove particulate matter from the condensate prior to the condensate entering the water tank 54. The system 50 further includes a plunger pump 60 to pump water from the water tank 54 under pressure to atomizing nozzles, each indicated at 62, provided at the top of the top section 16 of the frame structure 12 of the cooling unit 10. In one embodiment, the atomizing nozzles 62 are positioned within the exhaust air ducts 42 to introduce the atomized water in the relatively warm exhaust air being exhausted from the cooling unit 10. During operation, the system 50 is designed to collect the condensate in the water tank 54, atomize the condensate through atomizing nozzles 62, and spray the atomized water into exhaust air ducts 42. The condensate is brought out of cooling unit 10 by the exhaust air in the form of fog.

In a certain embodiment, the cooling unit 10 further includes a control system or "controller" 64 to control the operation of the cooling unit as well as provide communication with external devices. In one embodiment, the control system 64 may be provided as part of the cooling unit 10 or as a separate component to the cooling unit. In one such embodiment, the control system 64 may communicate with a data center computer system associated with the space to provide status of the components of the cooling unit 10, and to receive control commands from a Building Management System (BMS). In one particular embodiment, the control system 64 communicates with the data center computer system over a network, and in one such embodiment, the BMS may be implemented using an integrated data center control and monitoring system, such as the InfraStruXure™ data center manager sold by American Power Conversion Corporation of West Kingston, R. I. Notwithstanding the particular configuration, the control system 64 is adapted to control the flow of coolant from the compressor 18 to the condenser 20 and the evaporator 22 depending on the temperature and pressure readings of the cooling unit 10. The control system 64 is further configured to control the operation of the evaporator fans 28 and the condenser fans 30 to control the flow of air over the evaporator 22 and the condenser 20, respectively, as well as the system 50 used to remove condensate from the cooling unit 10.

Figure 5:
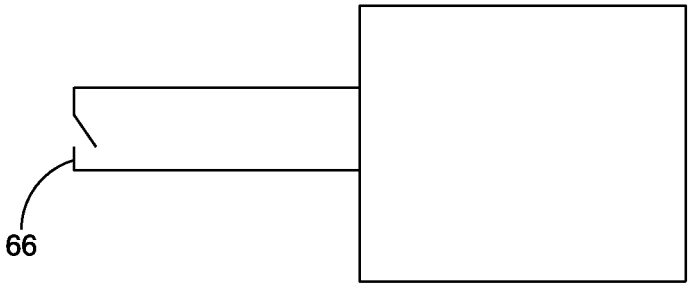
FIG. 5 is a schematic view of an overflow switch of the system for removing condensate.
Figure 6:
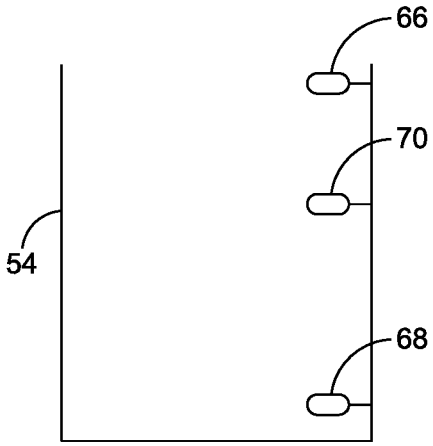
FIG. 6 is a schematic view of a water tank of the system for removing condensate.

Referring additionally to FIG. 5, the system 50 is configured to include an overflow switch 66 to trigger the plunger pump 60 to shut off the plunger pump and the cooling unit 10. Referring additionally to FIG. 6, the water tank 54 includes three switches, a low switch 68, a high switch 70 and the overflow switch 66. The low switch 68 shuts off the plunger pump 60 when water is lower than the low switch. The high switch 70 starts the plunger pump 60 when water is higher than the high switch. The overflow switch 66 will shut down the cooling unit 10 when water is higher than the overflow switch. The low switch 68, the high switch 70 and the overflow switch 66 are coupled to the control system 64 that controls the operation of the system 50 and the cooling unit 10. Referring back to FIG. 4, the system 50 further includes a pressure switch 72 to shut down the plunger pump 60 if water pressure cannot reach a certain head pressure.

Figure 7:
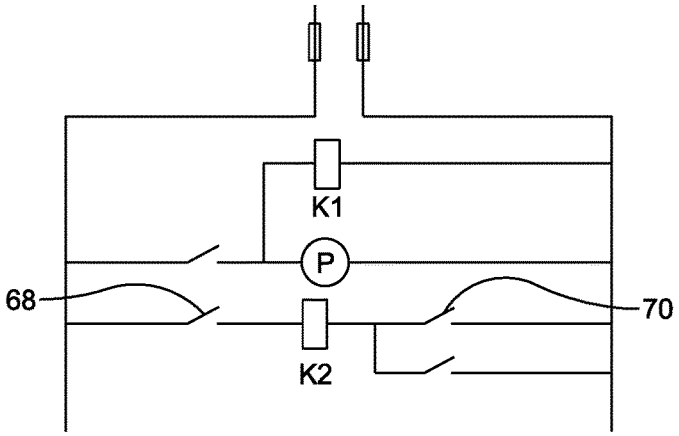
FIG. 7 is a schematic view of a switch assembly of the system for removing condensate.

In one embodiment, the water from drain pan 44 is pumped to the stainless steel water tank 54 after the condensate pump 52 is activated. When water reaches a certain level in the water tank 54 as defined by the position of the high switch 70, the high flow switch activates the plunger pump 60 to pressurize the water to 40 to 60 bar. This pressure is sufficient to atomize the water in the two atomizing nozzles 62, each having a diameter of 0.08 mm to 0.3 mm. The atomized water is sprayed into ambient air from the condenser 20 through the two exhaust air ducts 40, 42, which is exhausted from the cooling unit 10. The low switch 68 is used to turn the plunger pump 60 off, with the overflow switch 66 being configured to issue an alarm and shut off the whole system when it is activated. A schematic of the low switch 68 and the high switch 70 configuration is illustrated in FIG. 7.

Figure 8:
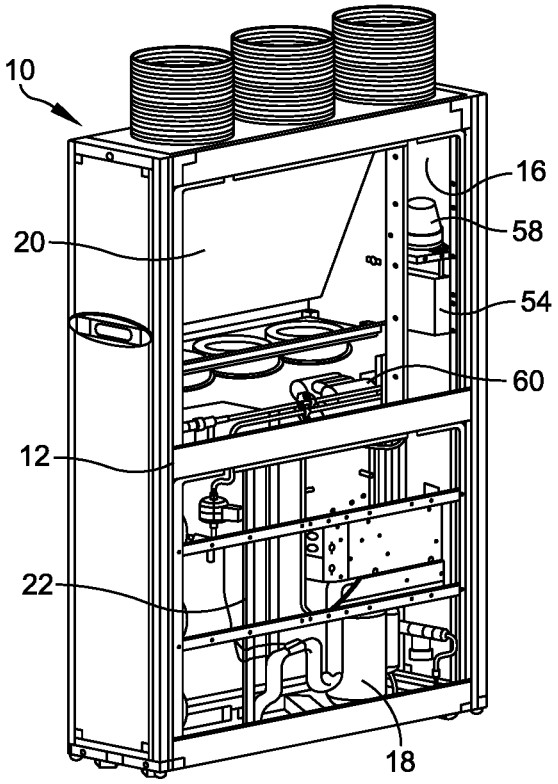
FIG. 8 is a perspective view of the cooling unit with panels removed to review certain other aspects of the system for removing condensate.
Figure 9:
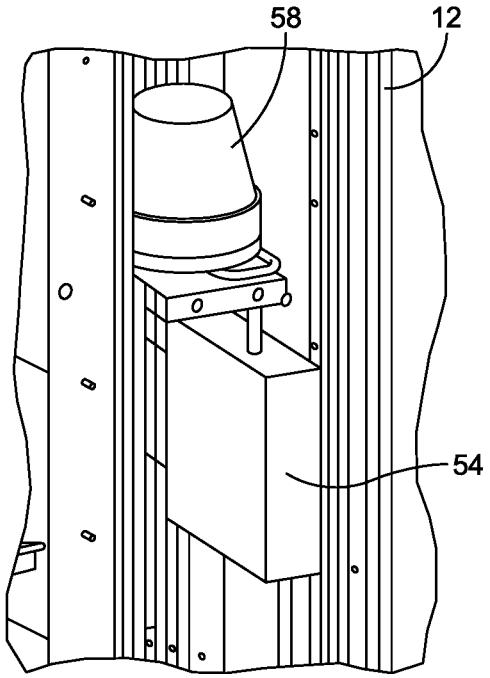
FIG. 9 is an enlarged perspective view showing a water tank and a strainer of the system for removing condensate.

Referring back to FIG. 3B, the drain pan 44 is located in the bottom section 14 of the frame structure 12 of the cooling unit 10 below the evaporator 22. In one embodiment, with reference to FIGS. 8 and 9, the water tank 54 and the strainer 58 are mounted in the top section 16 of the frame structure 12 of the cooling unit 10. The condensate pump 52 may be configured to continuously pump condensate to the strainer 58 and the water tank 54, or may be configured to pump condensate from the drain pan 44 when the condensate achieves a certain level within the drain pan. As shown, the water tank 54 and the strainer 58 are connected to a side of the frame structure 12 with the strainer mounted just above the water tank.

Figure 10:
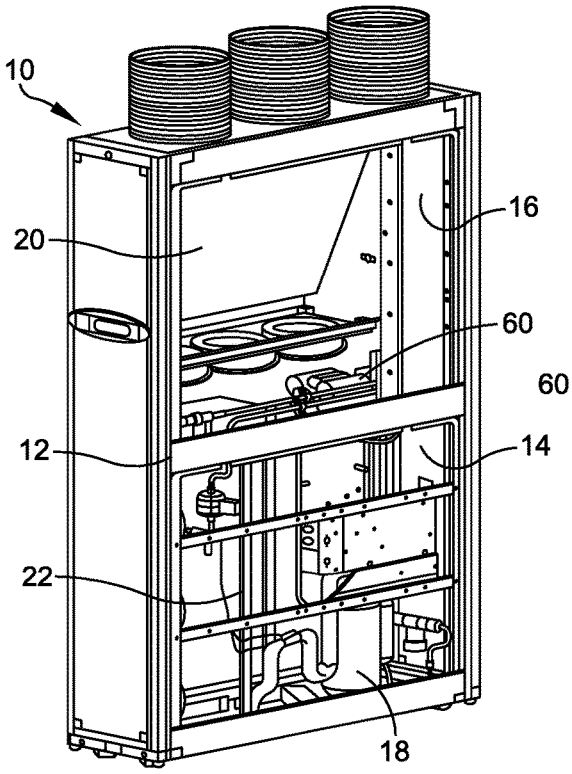
FIG. 10 is a perspective view of the cooling unit with panels removed to illustrate aspects of the system for removing condensate.
Figure 11:
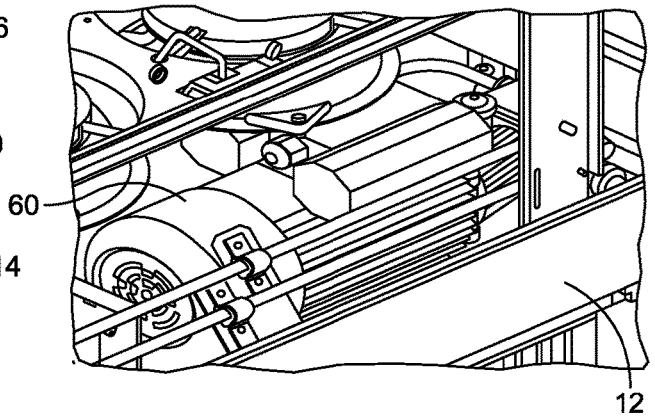
FIG. 11 is an enlarged perspective view showing a pump of the system for removing condensate.
Figure 12:
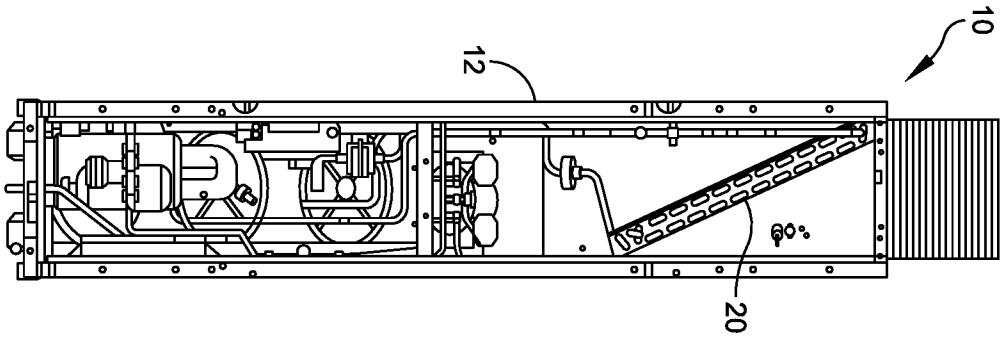
FIG. 12 is an end view of the cooling unit having the system for removing condensate.
Figure 13:
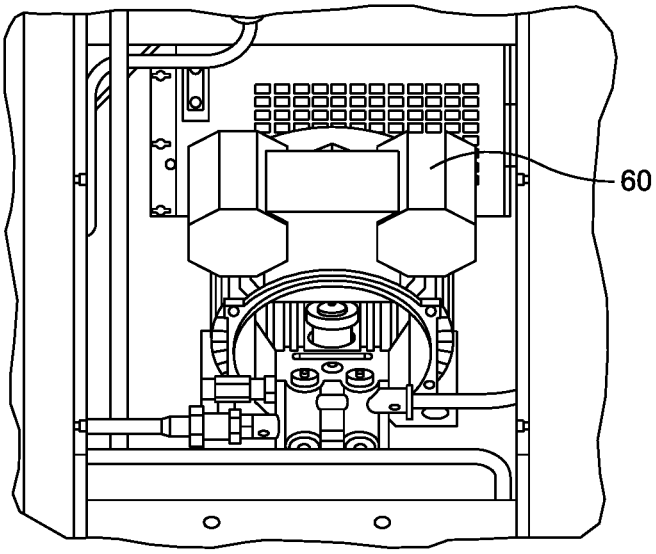
FIGS. 13 and 14 are enlarged end views of the pump of the system for removing condensate.
Figure 14:
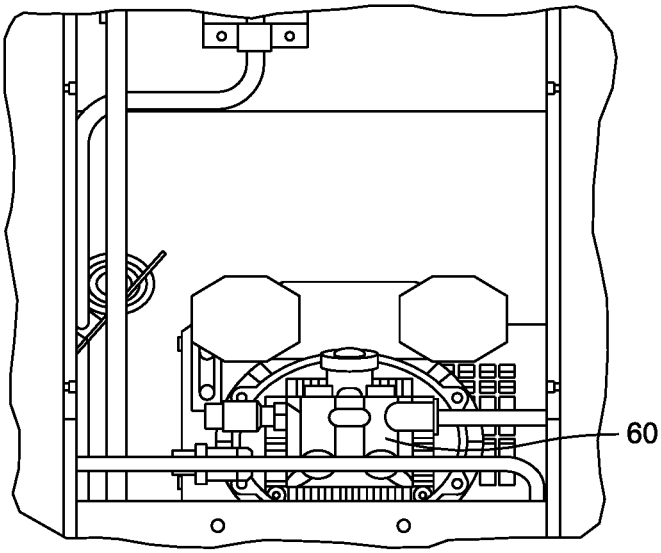

Referring to FIGS. 10 and 11, in one embodiment, the plunger pump 60 is mounted in the top section 16 of the frame structure 12 of the cooling unit 10. As shown, the plunger pump 60 is secured to the frame structure 12 and configured to pump water contained in the water tank 54 to the atomizing nozzles 62. FIGS. 12-14 illustrate the plunger pump 60 and the components of the system 50 provided in the top section 16 of the frame structure 12 of the cooling unit 10.

Figure 15:
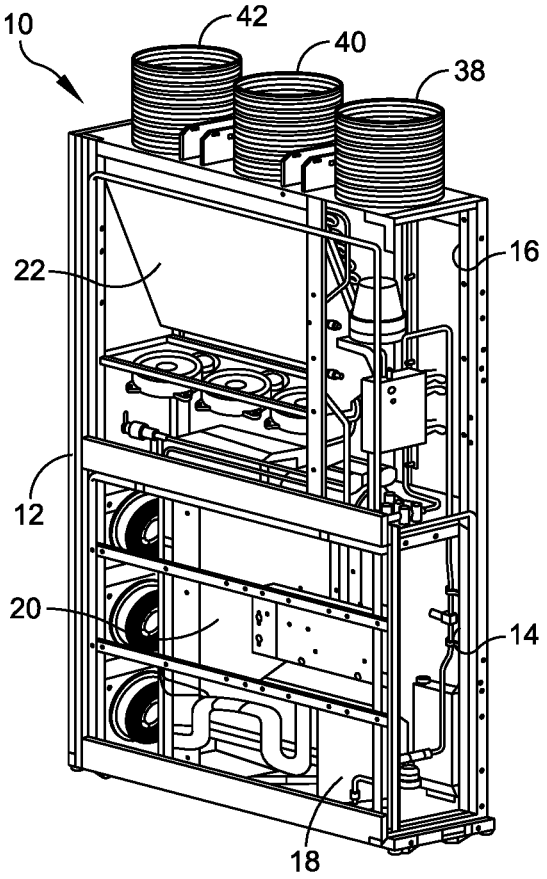
FIG. 15 is a perspective view taken from another perspective of the cooling unit having the system for removing condensate.
Figure 16:
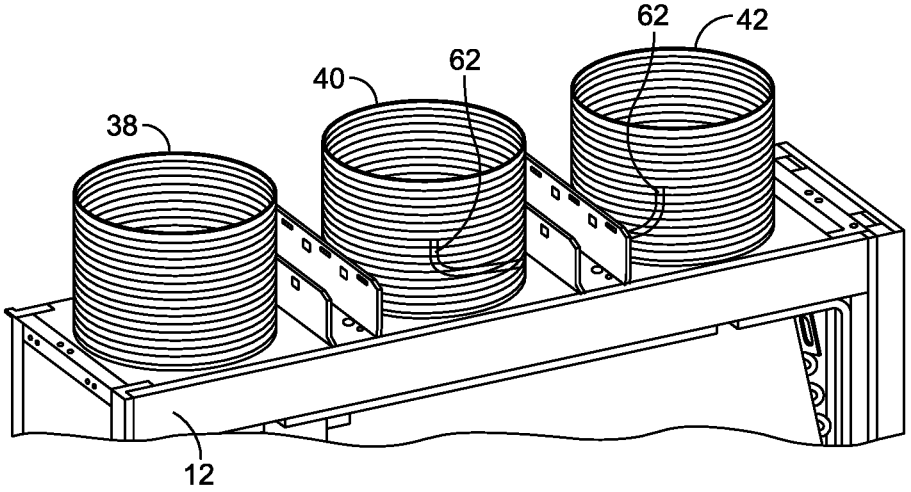
FIG. 16 is an enlarged perspective view of nozzles of the system for removing condensate.

FIGS. 15 and 16 illustrate the atomizing nozzles 62 provided in the two exhaust air ducts 40, 42 that are used to exhaust air from the condenser 20 into ambient or drop ceiling. As shown, each atomizing nozzle 62 is mounted within a center of the exhaust air duct 40 or 42, with the nozzle being supported by the end of the conduit 56. The arrangement is such that the high pressure fluid generated by the plunger pump 60 atomizes the water in the two atomizing nozzles 62. The atomized water is sprayed into ambient air from the condenser 20 through the two exhaust air ducts 40, 42, which is exhausted from the cooling unit 10.

During operation, condensate generated by the evaporator 22 is collected in the drain pan 44 located in the bottom section 14 of the frame structure 12 of the cooling unit 10 below the evaporator. The condensate is pumped from the drain pan 44 to a water tank 54 in fluid communication with the condensate pump 52. The water tank 54 is configured to store condensate in the form of water delivered to the water tank by the condensate pump 52. In one embodiment, the condensate is strained by the strainer 58 prior to pumping the condensate to the water tank 54 to remove particulate matter from the condensate prior to entering the water tank. The condensate pump 52 may be configured to operate continuously or when condensate reaches a certain elevation in the drain pan 44.

The water in the water tank 54 is pumped to the atomizing nozzles 62 disposed within the exhaust air ducts 40, 42 of the cooling unit 10 with the plunger pump 60. In a certain embodiment, the plunger pump 60 is shut off by the triggering of the low switch 68 when water is lower than the low switch. The plunger pump 60 is started by the triggering of the high switch 70 when water is higher than the high switch. In the event of an overflow situation, the cooling unit 10 is shut down with the overflow switch 66 when water is higher than the overflow switch.

In one embodiment, the low switch 68, the high switch 70 and the overflow switch 66 are coupled to the controller 64 that controls the operation of the system 50 and, in some embodiments, the cooling unit 10. The atomizing nozzles 62 are configured to atomize water delivered under pressure from the plunger pump 60, which mixes in the exhaust air traveling through the exhaust air ducts 40, 42. In one embodiment, the plunger pump 60 is configured to pressurize the water to 40 to 60 bar, and the atomizing nozzles 62 have a diameter of 0.08 mm to 0.3 mm.

Although two atomizing nozzles 62 are provided, with one for each exhaust air duct 40, 42, any number of atomizing nozzles can be provided to remove condensate from the cooling unit 10.

Embodiments of the system 50 to remove condensate from the cooling unit 10 are particularly effective in data centers. The system 50 can be shipped with the other components of the data center in single enclosure. The system 50 can be assembled with the other components of the data centers and tested in a factory environment.

Having thus described several aspects of at least one embodiment of this disclosure, it is to be appreciated various alterations, modifications, and improvements will readily occur to those skilled in the art. Such alterations, modifications, and improvements are intended to be part of this disclosure, and are intended to be within the spirit and scope of the disclosure. Accordingly, the foregoing description and drawings are by way of example only.

What is claimed is:

1. A system for removing condensate from a cooling unit configured to provide cooling to equipment racks in a data center, the cooling unit including an evaporator in fluid communication with a source of cooling fluid, at least one fan configured to draw air into the cooling unit and direct air over the evaporator, and an exhaust air duct configured to exhaust relatively warm air from the cooling unit, the system being configured to remove condensate from the evaporator, the system comprising:

a drain pan to collect condensate generated by the evaporator of the cooling unit;

a condensate pump configured to pump condensate from the drain pan;

a water tank in fluid communication with the condensate pump, the water tank being configured to store condensate in the form of water delivered to the water tank by the condensate pump;

a plunger pump in fluid communication with the water tank, the plunger pump being configured to pump water from the water tank; and at least one atomizing nozzle in fluid communication with the plunger pump, the at least one atomizing nozzle being configured to atomize water from the plunger pump, wherein the at least one atomizing nozzle is positioned within the exhaust air duct of the cooling unit to exhaust relatively warm air from the cooling unit.

2. The system of claim 1, wherein the plunger pump is configured to pressurize the water to 40 to 60 bar.

3. The system of claim 2, wherein the at least one atomizing nozzle has a diameter of 0.08 mm to 0.3 mm.

4. The system of claim 1, further comprising a strainer in fluid communication with the condensate pump and the water tank to remove particulate matter from the condensate prior to entering the water tank.

5. The system of claim 1, wherein the water tank includes a low switch to shut off the plunger pump when water is lower than the low switch and a high switch to start the plunger pump when water is higher than the high switch.

6. The system of claim 5, wherein the water tank further includes an overflow switch to shut down the cooling unit when water is higher than the overflow switch.

7. The system of claim 6, wherein the low switch, the high switch and the overflow switch are coupled to a controller that controls the operation of the system and the cooling unit.

8. The system of claim 1, wherein the drain pan is positioned below the evaporator of the cooling unit.

9. The system of claim 1, further comprising at least one sensor provided in the water tank and a controller configured to control an operation of the condensate pump and the plunger pump based on readings taken by the at least one sensor.

10. A method of removing condensate from a cooling unit configured to provide cooling to equipment racks in a data center, the cooling unit including an evaporator in fluid communication with a source of cooling fluid, at least one fan configured to draw air into the cooling unit and direct air over the evaporator, and an exhaust air duct configured to exhaust relatively warm air from the cooling unit, the system being configured to remove condensate from the evaporator, the method comprising:

collecting condensate from the evaporator in a drain pan of the cooling unit;

pumping condensate from the drain pan to a water tank in fluid communication with a condensate pump, the water tank being configured to store condensate in the form of water delivered to the water tank by the condensate pump;

pumping water from the water tank to at least one atomizing nozzle in fluid communication with a plunger pump, the at least one atomizing nozzle being configured to atomize water from the plunger pump; and positioning the at least one atomizing nozzle within the exhaust air duct of the cooling unit to exhaust relatively warm air from the cooling unit.

11. The method of claim 10, wherein the plunger pump is configured to pressurize the water to 40 to 60 bar.

12. The method of claim 11, wherein the at least one atomizing nozzle has a diameter of 0.08 mm to 0.3 mm.

13. The method of claim 10, further comprising straining the condensate prior to pumping the condensate to the water tank with a strainer in fluid communication with the condensate pump and the water tank to remove particulate matter from the condensate prior to entering the water tank.

14. The method of claim 10, further comprising shutting off the plunger pump with a low switch when water is lower than the low switch and starting the plunger pump with a high switch when water is higher than the high switch.

15. The method of claim 14, further comprising shutting down the cooling unit with an overflow switch when water is higher than the overflow switch.

16. The method of claim 15, wherein the low switch, the high switch and the overflow switch are coupled to a controller that controls the operation of the system and the cooling unit.

17. The method of claim 10, further comprising positioning the drain pan below the evaporator of the cooling unit.

18. The method of claim 10, further comprising sensing an amount of water in the water tank with at least one sensor provided in the water tank and a controlling an operation of the condensate pump and the plunger pump based on readings taken by the at least one sensor.

* * * * *